US006914992B1

(12) United States Patent
van Halteren et al.

(10) Patent No.: US 6,914,992 B1
(45) Date of Patent: Jul. 5, 2005

(54) SYSTEM CONSISTING OF A MICROPHONE AND A PREAMPLIFIER

(75) Inventors: Aart Zeger van Halteren, Hobrede (NL); Claus Erdmann Furst, Roskilde (DK)

(73) Assignee: Sonion Nederland B.V., Amsterdam (NL)

( * ) Notice: Subject to any disclaimer, the term of this patent is extended or adjusted under 35 U.S.C. 154(b) by 0 days.

(21) Appl. No.: 09/346,220

(22) Filed: Jul. 1, 1999

(30) Foreign Application Priority Data

Jul. 2, 1998 (NL) ..... 1009544

(51) Int. Cl.[7] ..... H04R 3/00; H04R 25/00

(52) U.S. Cl. ..... 381/113; 381/174; 381/191; 381/322

(58) Field of Search ..... 381/113, 122, 381/191, 312, 317, 320, 322, 174, 92, 94.2, 408, 313; 367/181; 181/158; 414/554

(56) References Cited

U.S. PATENT DOCUMENTS

| | | | | | |
|---|---|---|---|---|---|
| 3,197,048 | A | * | 7/1965 | Kohler | 414/554 |
| 4,056,697 | A | * | 11/1977 | Heil | 381/408 |
| 4,063,050 | A | | 12/1977 | Carlson et al. | 381/113 |
| 4,331,840 | A | | 5/1982 | Murphy et al. | 381/345 |
| 4,450,930 | A | * | 5/1984 | Killion | 181/158 |
| 4,701,640 | A | | 10/1987 | Flygstad et al. | 307/400 |
| 4,764,690 | A | * | 8/1988 | Murphy et al. | 307/400 |
| 5,083,312 | A | * | 1/1992 | Newton et al. | 381/320 |
| 5,452,268 | A | * | 9/1995 | Bernstein | 367/181 |
| 5,812,679 | A | * | 9/1998 | Killion et al. | 381/316 |
| 5,889,872 | A | * | 3/1999 | Sooriakumar et al. | 381/174 |
| 6,031,922 | A | * | 2/2000 | Tibbetts | 381/313 |
| 6,084,972 | A | * | 7/2000 | van Halteren et al. | 381/92 |
| 6,154,547 | A | * | 11/2000 | Whitecar | 381/94.2 |
| 6,243,474 | B1 | * | 6/2001 | Tai et al. | 381/174 |
| 6,466,678 | B1 | * | 10/2002 | Killion et al. | 381/314 |
| 6,504,937 | B1 | * | 1/2003 | Papadopoulos et al. | 381/113 |

FOREIGN PATENT DOCUMENTS

| | | |
|---|---|---|
| EP | 0 533 284 A1 | 3/1993 |
| EP | 0 800 331 A2 | 10/1997 |

* cited by examiner

*Primary Examiner*—Xu Mei
*Assistant Examiner*—Andrew Graham
(74) *Attorney, Agent, or Firm*—Michaelson & Associates; Peter L. Michaelson; Alberta A. Vitale

(57) ABSTRACT

A system, more particularly a hearing aid, consisting of a microphone and a preamplifier, wherein the microphone comprises a housing having therein an opening to the surroundings, a diaphragm and a backplate, while the amplifier is coupled to the system consisting of the diaphragm and the backplate and has a field effect transistor as input element. In the housing, in a space which is bounded by, on the one hand, the diaphragm and, on the other, the housing wall, and which does not comprise the opening to the surroundings, a pressure equalization opening is present, which has a diameter such that in the audible audiospectrum it does not make an essential contribution to the suppression of low frequencies. In the input stage of the amplifier, at the output of the field effect transistor, a low-pass filter or a high-pass filter or a combination thereof is arranged. Through this measure, the frequency characteristic can be optimally influenced to suppress noise.

11 Claims, 3 Drawing Sheets

SYSTEM CONSISTING OF A MICROPHONE AND A PREAMPLIFIER

BACKGROUND OF THE INVENTION

1. Field of the Invention

This invention relates to a system consisting of a microphone and a preamplifier, wherein the microphone comprises a housing having therein an opening to the surroundings, a diaphragm and a backplate, while the amplifier is coupled to the system consisting of the diaphragm and the backplate and has a field effect transistor as input element.

2. Description of the Prior Art

The microphone is more particularly the microphone of a hearing aid. Such microphones and the associated preamplifiers (also hereinafter referred to as amplifiers) have been miniaturized further and further over the last years, so that, for instance, they can be accommodated inside, instead of outside, the ear, or even in the auditory duct. Accordingly as a microphone becomes smaller, its capacitance is generally lower. Since the noise produced by an amplifier is inversely proportional to the capacitance at the input thereof, such miniaturization of the microphone has as a drawback that the noise thereof increases more and more and has actually become dominant with respect to the noise of the amplifier, which used to be determinative. In the microphone, in the partition between the so-called front volume, which communicates with the surroundings via an opening sometimes referred to as the "snout", and the back volume, closed off with respect to the surroundings, a pressure equalization opening is present, which ensures that the back volume is not going to function as a barometer, thereby adversely affecting the operation of the microphone. The size of this pressure equalization opening also influences the noise behavior, because, in acoustic terms, it constitutes a resistance, and must therefore be dimensioned very accurately, with tolerances in the order of micrometers, which is a great technical problem.

For influencing the frequency behavior of a miniature microphone and improving the noise behavior, further, in the snout, often an element, such as a gauze or a drop of glue, is provided to attenuate high frequencies. Such elements can become soiled, for instance by earwax, so that not only the snout may become clogged, but also the frequency behavior is uncontrollably influenced.

Finally, a miniature microphone has a frequency response with a resonance peak in the audible high-frequency range, which also affects the noise behavior adversely. If the resonance peak is placed outside the audible frequency range, this, in turn, has yet other adverse consequences for the noise behavior.

SUMMARY OF THE INVENTION

The object of the invention, according to a first aspect, is to provide a solution to the above-outlined problems with noise in the low-frequency range, and to that end the invention provides, in a first embodiment, a system of the above-mentioned kind, wherein in the housing, in a space which is bounded by, on the one hand, the diaphragm and, on the other, the housing wall and which does not comprise the opening to the surroundings, a pressure equalization opening is present, which has a diameter such that in the audible audiospectrum it does not make an essential contribution to the suppression of low frequencies, and wherein, in the input stage of the amplifier, at the output of a MOS field effect transistor forming the input element, a high-pass filter is arranged.

According to this first aspect of the invention, either a pressure equalization hole is made in a housing wall instead of in the diaphragm, or the pressure equalization hole in the diaphragm is made so small, for instance about 20 $\mu$m, that it does not make any appreciable contribution to the noise. This has as a consequence, however, that the low-frequency filtering, which is usually obtained with the pressure equalization hole, is also lost. Low frequencies are not of importance for the audibility of speech and can, if they are not suppressed, lead to overloading of the hearing aid. Therefore, according to the invention, this low-frequency filtering has been moved to the preamplifier coupled to the transducer. The noise of an amplifier is also inversely proportional to the root of the real part of the impedance at the input thereof, so that a high input impedance, as with a MOS-FET, is favorable to the noise behavior.

A further object of the invention, according to a second aspect, is to provide a solution to the above-outlined problems with noise in the high-frequency range, and to that effect, the invention provides a system of the above-mentioned kind, wherein in the amplifier, a low-pass filter coupled to the output of a MOS field effect transistor forming the input element is arranged. Preferably, the filter is a second-order active filter. According to a first variant, the filter has an externally settable filter curve, that is, a settable cut-off frequency and/or quality factor. The components determining the filter curve can be arranged both in the microphone housing and outside thereof.

An important advantage of the use of an electronic filter for cutting off high frequencies is that it affords greater freedom in positioning the resonance peak in the response characteristic of the microphone and also that this position does not need to be as accurate. This resonance peak can be influenced by varying the stiffness of the diaphragm and/or varying the distance between the backplate and the diaphragm. In microphones without electronic filtering, the resonance peak is placed in the audible frequency range to enable attenuating noise of frequencies above that of the resonance peak. In the use of the invention, the resonance peak can be placed outside the audible range and with the aid of the electronic filter a virtually flat frequency response in the desired audible frequency range can be realized. Further, it is no longer necessary to provide elements in the snout to influence the frequency behavior. Through all these measures, the microphone capsule can be fabricated more cheaply, because fewer parts and/or manufacturing steps are needed, and the tolerances for the positions or dimensioning of a number of parts of the microphone do not need to be as accurate.

In addition to hearing aids, telecommunication equipment also forms a field of application of the microphone according to the invention.

BRIEF DESCRIPTION OF THE DRAWINGS

The invention will be further explained in the following, on the basis of an exemplary embodiment, with reference to the drawing. In the drawing.

DETAILED DESCRIPTION

Figure 1:
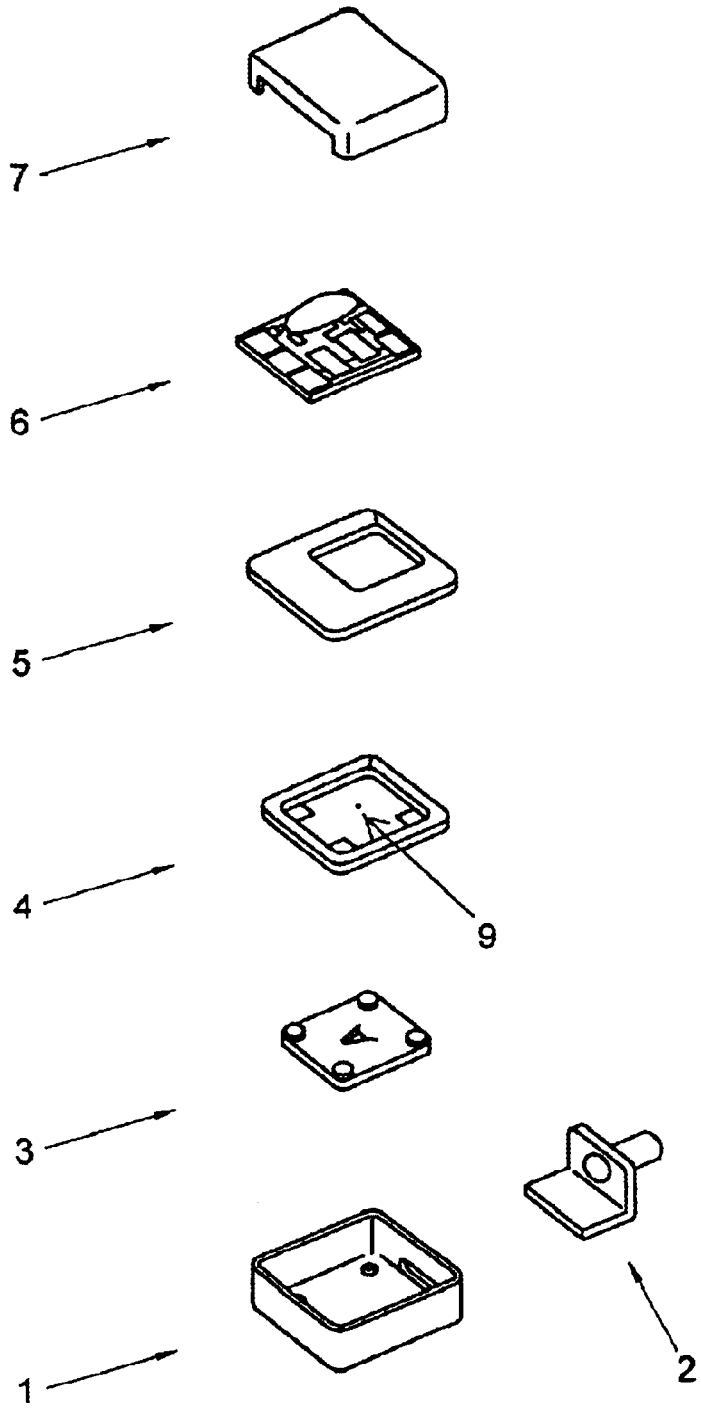
FIG. 1 is a schematic view of a microphone according to the invention.

FIG. 1 shows an exploded view of a microphone of the electret type, in which the invention can be applied. It is noted with emphasis, however, that the invention is applicable with any microphone in which the noise of the pressure equalization hole has a great influence on the overall noise of the microphone. The microphone comprises a first, box-shaped member 1, to which is connected a sound inlet opening, the so-called snout 2. In the box 1, a backplate 3, known per se, is mounted, and above the backplate, spaced therefrom, the diaphragm 4 is mounted in or on the circumferential edge of the box 1. Arranged above the diaphragm 4 is a mounting plate 5, on which the hybrid electronic circuit 6 is mounted. In the mounting plate, a hole is provided to enable connecting the circuit 6 electrically with the diaphragm. The housing is closed with the aid of a cover 7. The portion which is located "above" the diaphragm in the figure, that is, the mounting plate 5, the hybrid circuit 6 and the cover 7, jointly form the so-called back volume of the housing, which is closed off from the surroundings, in contrast to the volume communicating with the surroundings via the snout 2. To prevent the air chamber present in the back volume from going to work as a barometer and disturbing the functioning of the microphone, it is conventional to provide in the diaphragm 4, for instance in the center thereof, a pressure equalization opening 9, of a diameter of a few tens to hundreds of $\mu$m. The above-described microphone is of a conventional type and is sold by applicant in the so-called "90-series". It is known that the diameter of the pressure equalization hole has an influence on the low-frequency behavior of the microphone.

Figure 2:
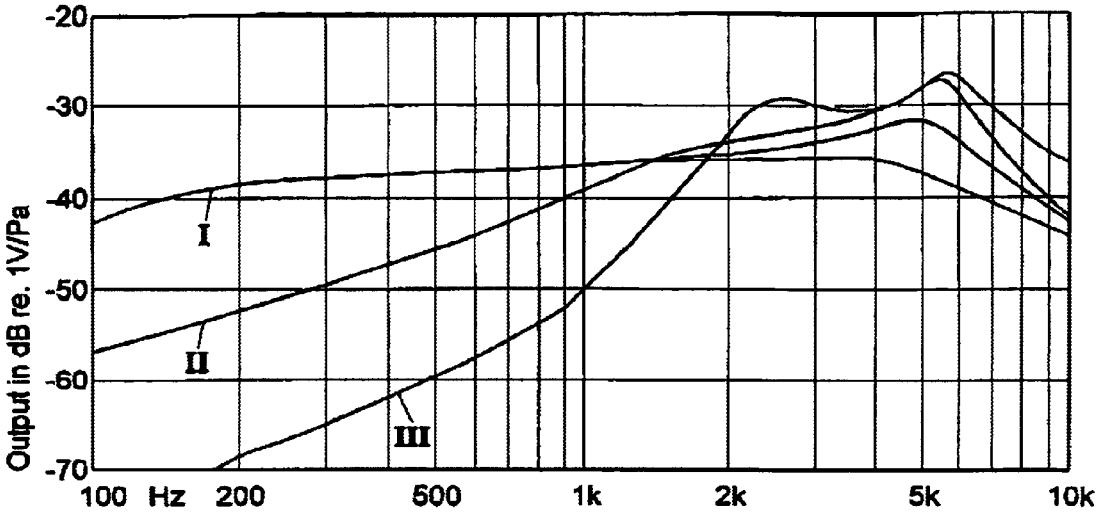
FIG. 2 is a frequency characteristic of a conventional microphone.

FIG. 2 shows this influence of the diameter of the pressure equalization opening on the frequency characteristic. In this figure, curve I shows the transmission at a hole diameter of 49 $\mu$m, curve II at a hole diameter of 93 $\mu$m, and curve III at a diameter of 150 $\mu$m. This figure clearly shows that by selecting the hole diameter, the frequency characteristic for low frequencies can be given the desired shape in a simple manner. According to the invention, the diameter of the hole in the diaphragm 4 is, for instance, 30 $\mu$m or less, so that the crossover point below which frequency loss occurs comes to lie outside the audible audiospectrum, for instance at 20 Hz. Another possibility is not to provide a pressure equalization hole in the diaphragm but to provide an acoustic filter in the wall portion , e.g. cover 7, of the housing which, together with the diaphragm, forms the back volume, so that the hole does not have any influence on the frequency characteristic. This acoustic filter can have the form of a tube or a small aperture. Measurement has shown that when the pressure equalization hole is reduced in this way or moved to the housing wall, the microphone's inherent noise decreases by about 6 dB.

An additional advantage of the invention is that by the choice of either a very small diameter of the pressure equalization hole, or the provision thereof in a housing wall, the tolerance of the diameter of this hole no longer plays a role. The increasing quality requirements imposed on microphones in respect of low-frequency behavior require a hole diameter of, for instance, 50 $\mu$m with a tolerance of, for instance, 1 $\mu$m, which is very difficult to realize. In the invention, this problem no longer plays a role because the equality of the low-frequency filters, as they can now be accommodated in an IC for the preamplifier, is by definition large.

Also in the use of paired microphones, which at present is conventional in hearing aids to improve the directional response pattern, it is an advantage that the low-frequency behavior is no longer determined by the microphone itself, but by an external filter, because in such paired microphones very stringent requirements are imposed on the equality of the phase and frequency characteristic.

Figure 3:
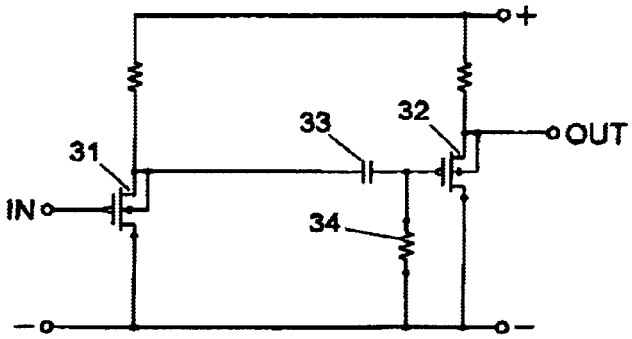
FIG. 3 is an electronic diagram of a possible preamplifier according to the first embodiment of the invention.

FIG. 3 schematically shows a first embodiment of a preamplifier which can be used in the system according to the invention. The amplifier is built up around two MOS-FETs 31 and 32, which are fabricated in CMOS technique, which makes it possible to give the MOS-FET 31 an input resistance of a few TeraOhms and an input capacitance of only 1.6 pF. Other input elements having a high input impedance are also applicable, of course, and it is also possible to include the two stages of the amplifier in different techniques and even in different integrated circuits. The high-pass filter is realized by the capacitor 33 and the resistor 34 at the input of MOS-FET 32. With these components, the desired low-frequency crossover point can be fixed very easily, because they can be manufactured accurately in IC technique. The value of the capacitor 33 in practice amounts to a few hundreds of pF and the value of the resistor 34 a few MΩ. At the output of MOS-FET 32, the amplified microphone signal is available for further processing.

The assembly of microphone and amplifier functions optimally from a noise suppression point of view, because the signal is attenuated for low frequencies only at a late stage. In addition, by the filter consisting of the capacitor 33 and the resistor 34, also low-frequency noise of the input section of the amplifier is attenuated. In practice, with the measures according to the invention, an improvement of the noise behavior of about 6 dB has been found to be possible, which, in terms of hearing, corresponds to a halving of the observed noise.

Figure 4A:
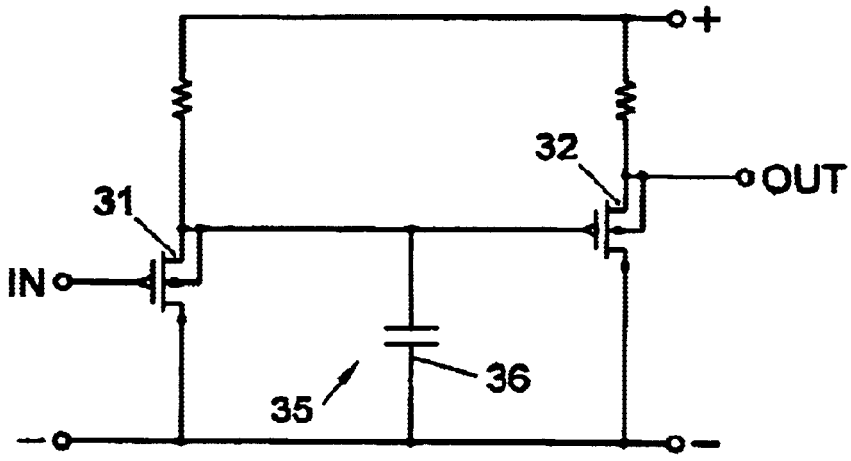
FIG. 4*a* is an electronic diagram of a possible preamplifier according to a second embodiment of the invention.

FIG. 4*a* shows the circuit according to FIG. 3, in which now, according to the second embodiment, a simple variant of a low-pass filter 35 in the form of a capacitor 36 is arranged.

Figure 4B:
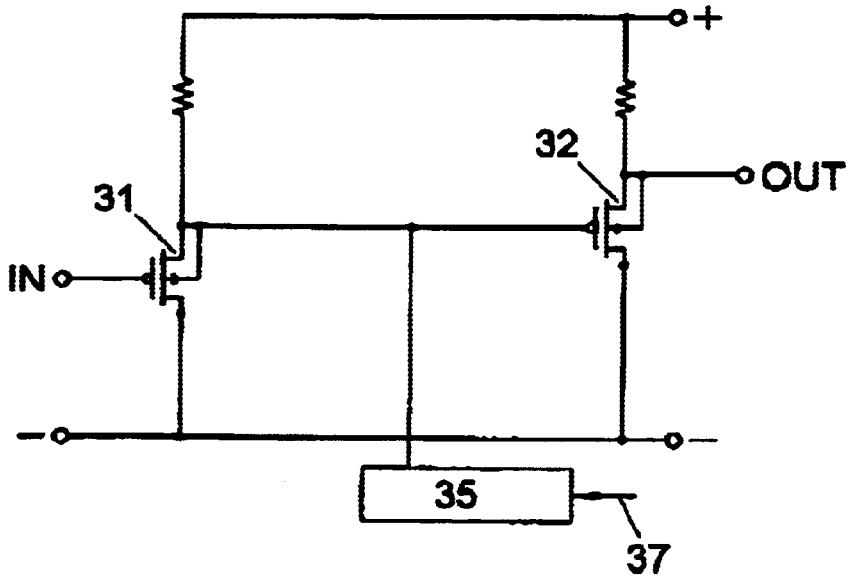
FIG. 4*b* is a diagram in a more general form of the circuit according the second embodiment.

FIG. 4*b* shows more schematically that the low-pass filter 35 can be integrated into the amplifier proper or outside thereof, accommodated in the microphone housing or not. Further, the filter can be externally settable via 37, both as regards cut-off frequency and quality factor. Setting can be done manually, or the filter, if it is suited therefor, can be programmed by means of a serial or parallel interface. Various solutions to that end are well known to those skilled in the art of electronics.

Naturally, the variants of the first and second embodiment of the invention can be very well combined with each other to realize a microphone with a fully electronically settable frequency characteristic.

What is claimed is:

1. A system having a microphone and a preamplifier, wherein the microphone comprises a housing having a sound inlet opening to external surroundings, a diaphragm and a backplate, the preamplifier being connected to the microphone and having a first stage with an MOS field effect transistor as an input element, wherein the system further comprises:

a pressure equalization opening situated in either a wall of the housing or the diaphragm and open to air spaces within the housing and on opposing sides of the diaphragm so as to permit air flow there between, wherein the pressure equalization opening is separate from the sound inlet opening and has a diameter sized such that in an audible audio spectrum the pressure equalization opening does not make an essential contribution to suppression of low frequencies; and a high-pass filter situated at an input of a second stage within the preamplifier and at an output of the input element formed of the MOS field effect transistor.

2. The system according to claim 1 wherein the pressure equalization opening is provided in the diaphragm and has a diameter that is less than 30 $\mu$m.

3. The system according to claim 1 wherein the pressure equalization opening is provided in the housing wall.

4. A system having a microphone and a preamplifier, wherein the microphone comprises a housing having an opening to external surroundings, a diaphragm and a backplate, the microphone having a frequency response with a resonance peak, the preamplifier being connected to the microphone and having a first stage with an MOS field effect transistor as an input element, wherein the resonance peak lies outside of an audible frequency range and the preamplifier comprises a second-order low-pass filter coupled to an output of the MOS field effect transistor.

5. The system according to claim 4 wherein a cut-off frequency or a quality factor of the low-pass filter is externally settable.

6. A system having a microphone and a preamplifier, wherein the microphone comprises a housing having a sound inlet opening to external surroundings, a diaphragm and a backplate, the preamplifier being connected to the microphone and having a first stage with an MOS field effect transistor as an input element, wherein the system further comprises:

a pressure equalization opening situated in either a wall of the housing or the diaphragm and open to air spaces within the housing and on opposing sides of the diaphragm so as to permit air flow there between, wherein the pressure equalization opening is separate from the sound inlet opening and has a diameter sized such that in an audible audio spectrum the pressure equalization opening does not make an essential contribution to suppression of low frequencies;

a high-pass filter situated at an input of a second stage within the preamplifier and at an output of the input element formed of the MOS field effect transistor; and a low-pass filter coupled to the output of the MOS field effect transistor.

7. The system according to claim 6 wherein the pressure equalization opening is provided in the diaphragm and has a diameter less than 30 $\mu$m.

8. The system according to claim 6 wherein the pressure equalization opening is provided in the housing wall.

9. The system according to claim 6 wherein the low-pass filter is a second-order filter.

10. The system according to claim 6 wherein a cut-off frequency or a quality factor of the low-pass filter is externally settable.

11. The system according to claim 6 wherein the microphone has a frequency response with a resonance peak, wherein the resonance peak lies outside an audible frequency range.

* * * * *